United States Patent [19]

Morton

[11] 4,405,847

[45] Sep. 20, 1983

[54] ARC CHUTES

[75] Inventor: John S. Morton, Wilmslow, England

[73] Assignee: Whipp & Bourme (1975) Limited, Lancaster, England

[21] Appl. No.: 330,808

[22] Filed: Dec. 15, 1981

[30] Foreign Application Priority Data

Dec. 23, 1980 [GB] United Kingdom ..... 8041216

[51] Int. Cl.[3] ..... H01H 33/08

[52] U.S. Cl. ..... 200/144 R; 200/147 R

[58] Field of Search ..... 200/144 R, 147 R, 147 B

[56] References Cited

U.S. PATENT DOCUMENTS

| | | | |
|---|---|---|---|
| 2,147,419 | 2/1939 | Baker | 200/147 B |
| 2,215,797 | 9/1940 | Sauer | 200/147 B |
| 3,270,171 | 8/1966 | Latour | 200/144 R |
| 3,728,503 | 4/1973 | Clausing et al. | 200/144 R |

*Primary Examiner*—Robert S. Macon

*Attorney, Agent, or Firm*—Kemon & Estabrook

[57] ABSTRACT

An arc chute for a circuit breaker includes a plurality of arc splitter plates 2, each plate having a pair of spaced parallel limbs 4,6 merging into a block portion. The arc chute also includes a pair of insulating barriers each containing a row of spaced channels arranged normally to a major longitudinal edge of the barrier, each channel encompassing one of the limbs 4,6 of each of the arc splitter plates. The insulating barriers may include a plurality of insulating members 12 each member having a protruding platform 28 and a stepped recess 17 such that two similar members may be engaged by superimposing one with the other with the protruding platform 28 of one engaging the stepped recess 17 of the other so as to provide a channel. The arc chute also includes a pair of arc conductors 32 which extend axially in register with respect to each other intermediate the barriers.

12 Claims, 6 Drawing Figures

ARC CHUTES

DESCRIPTION

This invention relates to arc chutes and more particularly to cold cathode arc chutes for circuit breakers.

According to the invention there is provided an arc chute for a circuit breaker including a plurality of arc splitter plates each plate having a pair of spaced parallel limbs merging into a block portion, a pair of spaced apart insulating barriers each barrier containing a row of spaced parallel channels arranged normally to a major longitudinal edge of the barrier each channel encompassing one of the limbs of each of the arc splitter plates, the block portions thereof extending intermediate the barriers, and a pair of arc conductors traversing the block portions of the arc splitter plates adjacent the end portions of the barriers and extending axially in register with respect to each other intermediate the barriers.

An arc chute for a circuit breaker also includes a plurality of arc splitter plates each plate having a pair of spaced parallel limbs merging into a block portion, a pair of spaced apart insulating barriers each barrier including a plurality of insulating members each member having a protruding platform and a stepped recess that two similar members may be engaged by superimposing one with the other with the protruding platform one engaging the stepped recess of the other so as to form a channel, the plurality of insulating members of each barrier forming channels which are arranged normally to a major longitudinal edge of the barrier, each channel encompassing one of the limbs of each of the arc splitter plates, the block portions thereof extending intermediate the barriers, and a pair of arc conductors traversing the block portions of the arc splitter plates adjacent the end portions of the barriers and extending axially in register with respect to each other intermediate the barriers.

The invention will now be described by way of example and with reference to the accompanying diagrammatic drawings in which.

Figure 1:
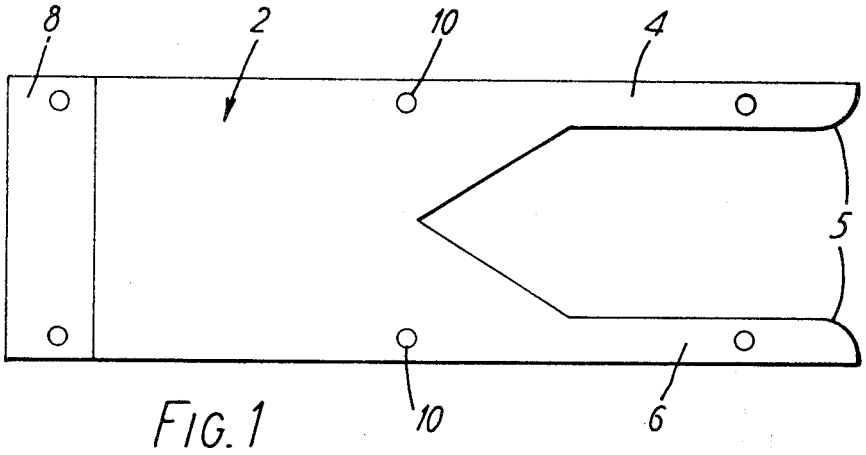
FIG. 1 is a plan view of an arc splitter plate.

With reference to FIG. 1 of the drawings an arc chute includes a plurality of steel arc splitter plates 2. Each plate has a pair of spaced parallel limbs 4, 6 of rectangular cross-section diverging from a central notch and having ends 5 of quadrant form centred on the outer edge portions of the limbs. At an end portion 8 remote from the limbs the plate is coated with an insulating material. Spaced along each limb and opposed edge regions of the rectangular portion are a series of aligning bores 10.

Figure 2:
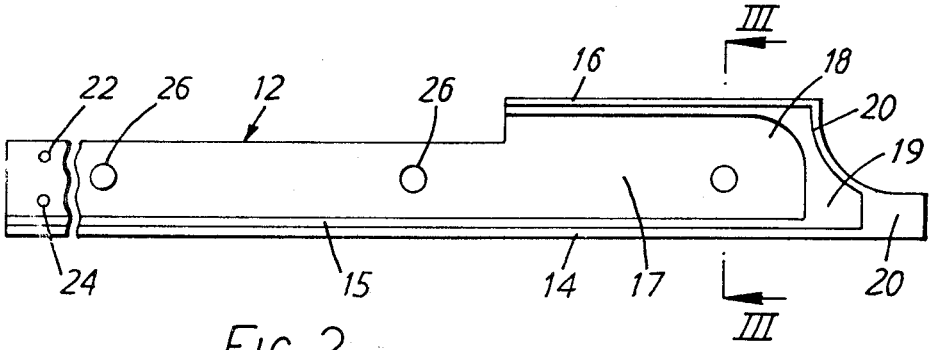
FIG. 2 is a plan view of an insulating member.
Figure 3:
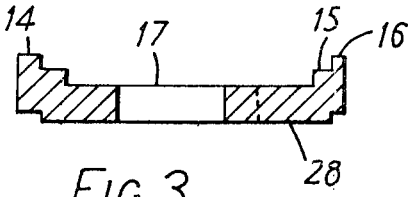
FIG. 3 is a cross-sectional elevation of the insulating member of FIG. 2 taken along the line III—III.

With reference to FIGS. 2 and 3 of the drawings a pair of insulating barriers includes a plurality of similar insulating members 12, each member is formed from a longitudinally extending strip which has extending along a first major edge portion 14 of one surface and along an end portion of the other or second major edge

16 of the surface, a stepped flange 15 so forming a stepped rectangular recess 17 intermediate the flanges. Beyond the end portion the said other major edge 16 is cut back. At an end of the stepped recess remote from the cut-back, the shoulder of the stepped flange is formed into a first quadrant abutment 18 centred on the first edge, complementary in shape to that of the ends of the limbs 5 of the arc splitter plates 2. Extending beyond the first quadrant abutment is a labyrinth region 19 which terminates in a second quadrant abutment 20 extending tangentially to the first quadrant abutment 18 formed by the upper portion of the flanges. The second quadrant abutment forms a leg 20 at the end of the strip.

Arranged at an end portion of the strip remote from the stepped recess and on the same surface is a pair of raised circular bosses 22, 24 whose height is equal to that of the shoulder of the first stepped flange.

Intermediate the circular bosses and the first quadrant abutment are a plurality of aligning bores 26 corresponding to the aligning bores 10 in the arc splitter plates 2.

On the obverse surface of the strip to that of the stepped recess 17 is a raised platform 28 which extends over the length of the strip in alignment with the upper portion of the flange on the face of the strip. The raised platform 28 is of a height identical with that of the distance between the upper surface of the shoulder of the flange and the upper portion of the flange.

Figure 4:
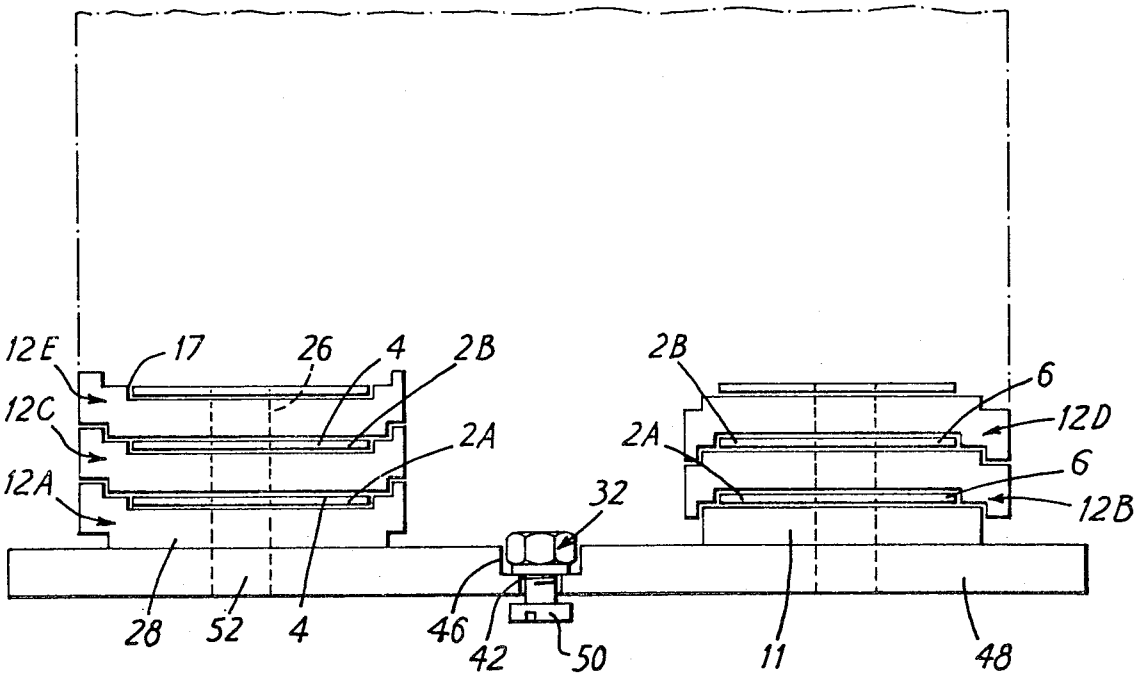
FIG. 4 is a diagrammatic sectional plan elevation of a portion of an arc chute.

With reference to FIG. 4 of the drawings also included in the arc chute are a plurality of vent spacer plates 30 made of an insulating material. Each plate is formed from a rectangular sheet into which are drilled at two adjacent corner regions a pair of bores corresponding in diameter an alignment to the circular bosses 22, 24 on the insulating members 12.

Figure 5:
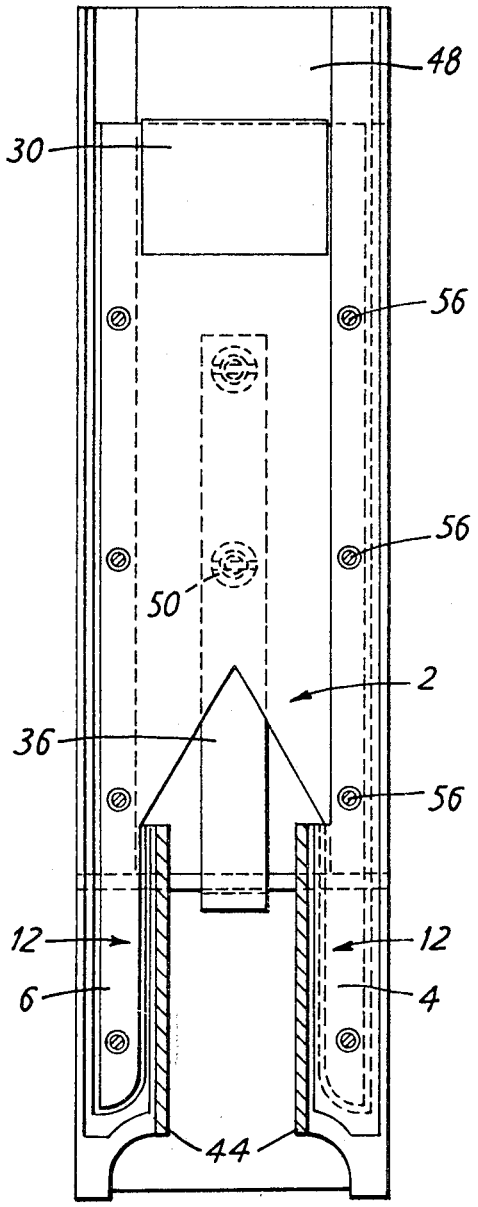
FIG. 5 is an end elevation of an assembled arc chute with one of a pair of end plates removed.
Figure 6:
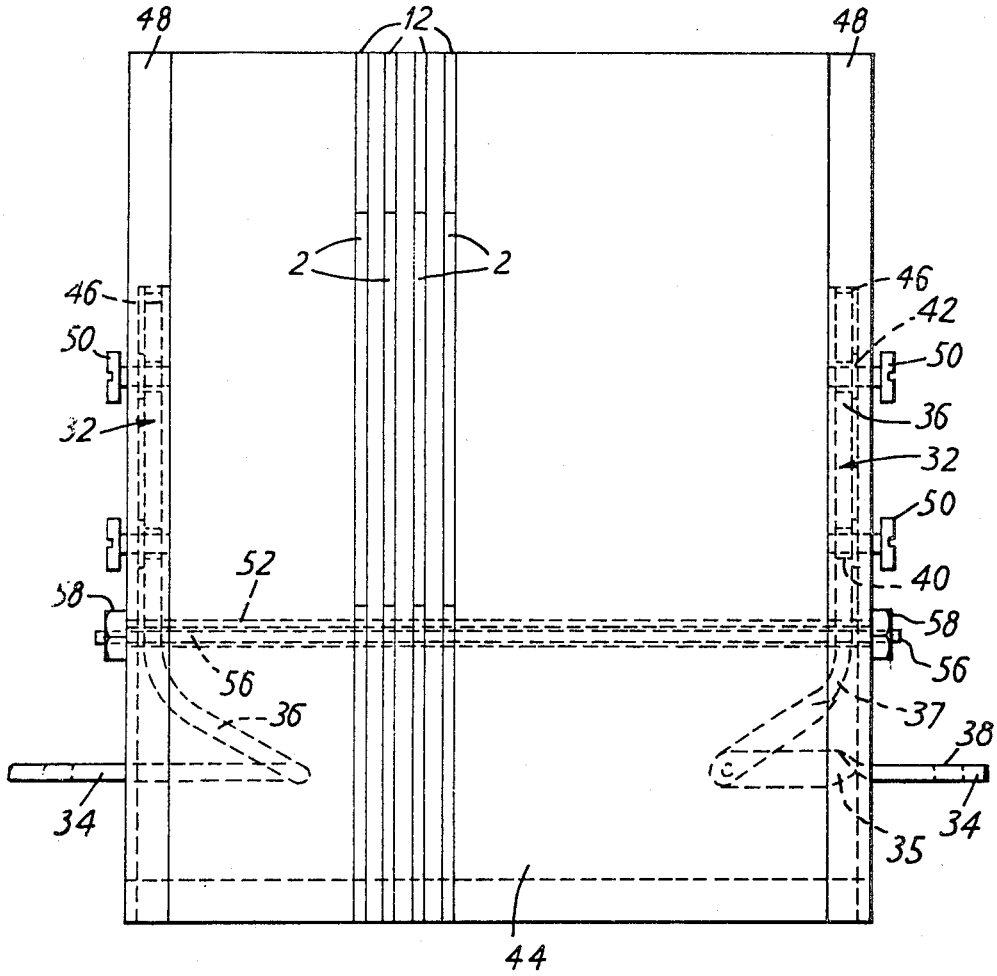
FIG. 6, is a side elevation of the assembled arc chute showing one of a pair of arc conductors in detail.

With reference to FIGS. 3, 4 and 5 of the drawings the arc chute further includes a pair of arc conductors 32 known as runners made from extruded copper stock. Each runner includes a first rectangular section bar 34 twisted through 90° at a region 33 intermediate of the free ends thereof, and a second rectangular section bar 36 of greater length than the first bar. The second bar is twisted through 90° at a region 32 adjoining one of the free ends and bent into an acute angle at the region of twist. The free end of the second bar adjacent the region of twist is welded to a free end of the first bar 34 so that the regions of twist 33, 37 of each bar 34, 26 are mutually opposed, and such that the remaining free end of the first bar 34 is normal to the remaining free end of the second bar 36. The remaining free end of the first bar 34 is drilled to provide a bore 38. Intermediate the region 37 of twist of the second bar and the remaining free end thereof are a plurality of bores 40 provided with external apertured bosses 42 on a side remote from the welded join between the first and second bars 34, 36.

With reference to FIGS. 4 and 5 of the drawings, also included in the arc chute are a pair of liner plates 44 made of refractory material, having a rectangular portion from one central edge portion of which extends a rectangular tab portion (not shown).

With reference to FIGS. 1, 2, 3, 4, 5 and 6 and in particular FIG. 4 on assembly, one of the pair of runners 32 is fitted into a groove 46 provided with bores formed in a rectangular end plate 48 made of insulating material, by mating insulated fixing screws 50 with the bores 40 in the second bar 36 of the runner so that the bosses 42 are in contact with the exposed surface of the groove 46. The first bar 34 of the runner projects away from the end plate. The end plate 48 is provided with a plurality of aligned bores 52 on either side of the groove which correspond to the bores 26 in the insulating members 12 and the bores 10 in the arc splitter plates 2.

Then a first insulating member 12A is positioned to one side of the groove 46 containing the second bar 36 of the runner so that the raised platform 28 of the first insulating member 12 is in contact with the surface of the side plate containing the groove 46 and so that the stepped recess 17 of the first insulating member is adjacent to the end portion of the groove 46 from which the first bar 34 of the runner projects. The aligning bores 26 in the first insulating member 12 are in register with those in the end plate 48.

A first packing member 11 provided with aligning bores, and made of a similar material to that of the insulating members, is then positioned in contact with the surface of the end plate 48 containing the groove 46 and on the opposite side of the groove 46 to that of the first insulating member 12A, so that the aligning bores in the first packing member 11 are in register with those in the end plate 48.

A first arc splitter plate 2A is then superimposed on the first packing member 11 and the first insulating member 12A so that one of the limbs 4 of the first arc splitter plate 2A is accommodated within the stepped recess 17 of the first insulating member 12A. The other limb 16 of the first arc splitter plate 2A is in contact with the packing member 11 and the rectangular portion (not shown in FIG. 4) of the first arc splitter plate spans the space between first insulating member 12A and the first packing member 11. The notch is remote from the welded region joining the first and second bars 34, 36 of the runner 32 and extends away from the cut back region of the stepped recess 17 in the first insulating member 12A so that the central region of the rectangular portion is exposed and so that one of the outer edge regions of the rectangular portion is in contact with the portion of the first insulating member 12A which extends beyond the stepped recess 17. Aligning bores 10 in the first arc splitter plate 2A are in register with those in first insulating member 12A first packing member 11 and the end plate 48.

A second insulating member 12B is then superimposed on the first arc splitter 2A so that the limb 6 of the first arc splitter plate 2A in contact with the first spacing member is accommodated within the stepped recess 17 of the second insulating member 12B, the other outer edge region of the rectangular portion of the first arc splitter plate 2A is in contact with the portion of the second insulating member 12B which extends beyond the stepped recess. The aligning bores 26 in the second insulating member 12B are in register with those in the first arc splitter plate 2A the first packing member 11 and the end plate 48.

A third insulating member 12C is then superimposed over the first insulating member 12A accommodating one of the limbs 4 of the first arc splitter plate 2A such that the raised platform 28 of the third insulating member 12C seats on the shoulders of the stepped flange of the first insulating member 12A thereby encompassing the limb 4 of the first arc splitter plate 2A within the stepped recess 17. The aligning bores 26 in the third insulating member 12C are registered with the aligning bores 10, 26, 52 in the first arc splitter plate 2A, the first insulating member 12A and the end plate 48 respectively.

A second arc splitter plate 2B is then superimposed over the second and third insulating members 12B, 12C so that one limb 4 of the second arc splitter plate 2B is accomodating within the stepped recess 17 of the third installing of member 12C. The rectangular portion (not shown in FIG. 4) of the second arc splitter plate 2B. spans the space between the second and third insulating members 12B, 12C so that the central region of the rectangular portion is exposed and so that the other limb 6 is in contact with the raised platform 28 of the second insulating member 12B. The aligning bores 10 in the second arc splitter plate 2B are registered with those in the first packing member 11, the second insulating member 12B, the first insulating member 12A, the third insulating member 12C and the end plate 48.

A first vent spacer plate 30 (not shown in FIG. 4) is then mounted on the second and third insulating members 12B, 12C so that the bores in the vent spacer plate 12C, and so that the vent spacer plate 30 rests on the raised platform 28 of the second insulating member 2B.

A fourth insulating member 12D is then superimposed on the second arc splitter plate 2B and the first vent spacer plate 30 so that the limb 6 of the second arc splitter plate 28 in contact with the raised platform 2B of the second insulating member 12B is accommodated within the stepped recess 17 of the fourth insulating member 12D. The rectangular portion (not shown in FIG. 4) of the second arc splitter plate 2B spanning the space between the insulating members 12, so that the central region thereof is exposed. The circular bosses 22, 24 of the fourth insulating member 12D mating with the bores in the first vent spacer plate 30 and the shoulder of the flange of the fourth insulating member 12D abutting against the raised platform 28 of the second insulating member 12B. The aligning bores in the fourth insulating member 12D are registered with the bores in the first and second arc splitter plates 2A, 2B the second insulating member 12B the first packing member 11 and the end plate 48.

A fifth insulating member 12E is then superimposed over the third insulating member 12C accommodating the limb 4 of the second arc splitter plate 2B such that the raised platform 28 of the fifth insulating member 12E seats on the shoulder of the flange of the third insulating member 12C thereby encompassing the limb 4 of the second arc splitter plate 2B within the stepped recess 17. The aligning bores in the fifth insulating member 12E are registered with the bores in the first and second arc splitter plates 2A, 2B., the first and third insulating members 12A, 12C and the end plate 48.

Stacking of the arc splitter plates 2, insulating members 12 and vent spacer plates 30 is then continued in the same way until a stack is obtained which contains preferably between 20 and 200 arc splitter plates, and a number of vent spacer plates preferably 1 per 30 arc splitter plates.

When the final sized stack has been achieved a second packing member (not shown in FIG. 4) is then placed upon one of the limbs 4 of the last arc splitter plate 2 in contact with the stack containing odd numbered insulating members 12A, 12C— so as to align the respective heights of the stacks of insulating members 12.

The other runner of the pair (not shown in FIG. 4) is then fitted into a groove 46 provided with bores in a second rectangular end plate 48 made of insulating material by mating insulating fixing screws 52 with the bores in the second bar 36 of the runner so that the apertured bosses attached thereto are in contact with lower surface of the groove, the first bar 34 of the runner projecting away from the end plate 48. The end plates 48 are provided with a plurality of aligning bores 52 on either side of the groove 46 which correspond to the bores in the insulating member 12 and the arc splitter plates 2.

The side plate 48 and attached runner are then superimposed on the stack of insulating members 12 and arc splitter plates 2 so that the runners are axially in register, and so that the aligning bores in the end plate align with the bores in the stack of insulating and arc splitter plates.

Rods 56 made of insulating material and having threaded end portions are then inserted into the co-axially extending aligning bores in the stack, and then threaded nuts 58 of insulating material are attached to the ends of the rods 56 projecting from a surface of the second end plate 48 remote from the groove 46 containing the runner. The stack is then inverted and threaded nuts 58 of insulating material are attached to the ends of the rods 56 which project from a surface of the first end plate 48 remote from the surface containing the groove 46 and runner, the stack thus being held rigid.

A pair of liner plates 44 are then positioned with the tab portions (not shown) in register one each side of the runners and in contact with the surfaces of the insulating members 12 adjacent to the runners and remote from the region spanned by the rectangular portions of the arc splitter plates 2.

Retainer plates (not shown) are then positioned over end portions of the liner plates 48 and a portion of the first bars 34 of the runners and attached to the end plates 48 so as to hold the liner plates captive.

Alternatively the rods may be inserted into the first end plate prior to the stacking of the arc splitter plates and insulating members, the rods acting as a mating means between the bores of the arc splitter plates and the insulating member. When final stacking has been achieved the rods are inserted into the bores in the second end plate and the insulated nuts attached thereto.

In operation the assembled arc chute is mounted on a circuit breaker having a pair of moveable arc initiating contacts which project into the space intermediate the liner plates 44 and the space intermediate the axially in register runners. The first bars 74 of the runners are electrically connected to the moveable arc initiating contacts and the circuit breaker is electrically connected to an electric supply by contacts which are attached to electrical conductors for example, bus bars. To initiate an arc the circuit breaker is switched into the electrical supply and a magnetic field is produced either by the arc itself or by coils within the circuit breaker. The moving arc initiating contacts are then rapidly moved apart and the arc thus created propogates along the runners and into the space between the liner plates 44 of the arc chute. The arc traverses the space intermediate the liner plates 44 and is prevented from rooting to the limbs 46 of the arc splitter plates 2 by the plurality of insulating members 12 which together encompass the limbs 4, 6 of the plurality of arc splitter plates 2. The shape of the arc splitter plate 2 and the presence of the magnetic field is such that the arc is drawn towards the apices of the notches in each of the arc splitter plates 2. At the notch the presence of the magnetic field is mitigated and the arc is broken down into a plurality of arcs known as series arcs. The series arcs root to the exposed regions of the rectangular portions of each arc splitter plate 2 and traverse the exposed region of each arc splitter plate 2 up to the portion 8 coated with insulating material.

The series arcs can be maintained within the exposed region of the rectangular portions of the arc splitter plates 2 until arc extinguishing is required. Extinguishing the series arcs is achieved by maintaining sufficient arc voltage so that the resultant arc resistance increases and forces the current to zero. The series arcs are prevented from escaping from the arc chute by the presence of the coating 8 of insulating material on the arc splitter plates 2. Ionized gas produced during the propogation of the series arcs is vented through the spacing between the upper portion of the arc splitter plates 2 and any restriking of the arc within the clouds of ionized gas is reduced by the presence of the vent spacer plates 30 which are in the path of the gases being conducted away from the arc chute.

It will be appreciated that depending upon the design of the circuit breaker, in particular the positioning of the arc initiating contacts that a number of arc splitter plates and associated insulating members adjacent the side plates of the arc chute can be of smaller longitudinal dimensions than those of the insulating members and associated arc splitter plates which span and are adjacent to the arc initiating contacts.

It will also be appreciated that the plurality of insulating members may be of integral construction thereby forming a pair of spaced apart insulating barriers having a plurality of spaced apart parallel channels arranged normally to the space between the barriers.

Also it will be appreciated that the liner plates may be of integral construction with the insulating barriers, the insulating barrier in this instance being made of refractory material.

Further it should be appreciated that a pivot housing may be attached to one of the side plates of the arc chute such that when the arc chute is mounted on the circuit breaker the arc chute may be pivoted away from the circuit breaker to inspect the arc chute and to carry out maintenance operations on both the arc chute and the circuit breaker.

It should further be appreciated that a lifting handle may be mounted on to one of the side plates of the arc chute to aid in lifting of the arc chute.

I claim:

1. An arc chute for a circuit breaker including a plurality of arc splitter plates each plate having a pair of spaced parallel limbs merging into a block portion, a pair of spaced apart insulating barriers each barrier containing a row of spaced parallel channels arranged normally into a major longitudinal edge of the barrier each channel encompassing one of the limbs of each of the arc splitter plates, the block portions thereof extending intermediate the barriers, and a pair of arc conductors traversing the block portions of the arc splitter plates adjacent the end portions of the barriers and extending axially in register with respect to each other intermediate the barriers.

2. An arc chute for a circuit breaker as claimed in claim 1, wherein the channels are blind and accommodate in addition to the limbs of the arc splitter plates an outer edge portion of the block portions of each arc splitter plate.

3. An arc chute for a circuit breaker as claimed in claim 2, wherein the channels extend beyond that portion which is associated with the arc splitter plates so as to accommodate a plurality of vent spacer plates.

4. An arc chute for a circuit breaker as claimed in claim 3, wherein a pair of liner plates are arranged on each side of the axially extending arc conductors adjacent to each insulating barrier.

5. An arc chute for a circuit breaker as claimed in claim 4, wherein the liner plates are of integral construction with the insulating barriers.

6. An arc chute for a circuit breaker as claimed in claim 5, wherein a pivot housing is attached at one end of the pair of insulating barriers.

7. An arc chute for a circuit breaker also includes a plurality of arc splitter plates each plate having a pair of spaced parallel limbs merging into a block portion, a pair of spaced apart insulating barriers each barrier including a plurality of insulating members each member having a protruding platform and a stepped recess such that two similar members may be engaged by superimposing one with the other with the protruding platform one engaging the stepped recess of the other so as to form a channel, the plurality of insulating members of each barrier forming channels which are arranged normally to a major longitudinal edge of the barrier, each channel encompassing one of the limbs of each of the arc splitter plates, the block portions thereof extending intermediate the barriers, and a pair of arc conductors traversing the block portions of the arc splitter plates adjacent the end portions of the barriers and extending axially in register with respect to each other intermediate the barriers.

8. An arc chute for a circuit breaker as claimed in claim 7, wherein the channels are blind and the channels of the insulating members forming each barrier accommodates in addition to the limbs of the arc splitter plates an outer edge portion of the block portions of each arc splitter plate.

9. An arc chute for a circuit breaker as claimed in claim 8, wherein the channels of the insulating members forming each barrier extend beyond that portion which is associated with the arc splitter plates so as to accommodate a plurality of vent spacer plates.

10. An arc chute for a circuit breaker as claimed in claim 9, wherein a pair of liner plates are arranged on each side of the axially extending arc conductors adjacent to each insulating barrier.

11. An arc chute for a circuit breaker as claimed in claim 10, wherein the liner plates are of integral construction with the insulating barriers.

12. An arc chute for a circuit breaker as claimed in claim 11, wherein a pivot housing is attached at one end of the pair of insulating barriers.

* * * * *